US010420997B1

(12) United States Patent
Hedley et al.

(10) Patent No.: US 10,420,997 B1
(45) Date of Patent: Sep. 24, 2019

(54) HOCKEY TRAINING APPARATUS WITH NOVEL PUCK REBOUNDERS AND FOLD-UP STORAGE FUNCTION

(71) Applicant: Douglas H. Hedley, Dauphin (CA)

(72) Inventors: Douglas H. Hedley, Dauphin (CA); Peter Gross, Elm Creek (CA)

(73) Assignee: Douglas H. Hedley, Dauphin (CA)

( * ) Notice: Subject to any disclaimer, the term of this patent is extended or adjusted under 35 U.S.C. 154(b) by 0 days.

(21) Appl. No.: 16/048,941

(22) Filed: Jul. 30, 2018

(51) Int. Cl.
*A63B 69/00* (2006.01)
*A63B 102/24* (2015.01)

(52) U.S. Cl.
CPC ..... *A63B 69/0026* (2013.01); *A63B 69/0097* (2013.01); *A63B 2102/24* (2015.10)

(58) Field of Classification Search
CPC ..... A63B 69/0026; A63B 2210/50
USPC ..... 473/446; 482/54
See application file for complete search history.

(56) References Cited

U.S. PATENT DOCUMENTS 3,955,815 A * 5/1976 Deschesnes ..... A63B 69/0026 473/446
4,026,545 A * 5/1977 Schonenberger ..... A63B 17/00 482/54
4,070,017 A * 1/1978 Lombardi ..... A63B 69/0091 473/144
5,161,799 A * 11/1992 Nandra ..... A63B 69/0026 473/194
5,351,960 A * 10/1994 Knapp ..... A63B 57/405 473/182
6,099,420 A * 8/2000 Nandra ..... A63B 69/0026 473/446
7,905,800 B2 * 3/2011 Oneschuk ..... A63B 69/0024 473/422
8,469,841 B1 * 6/2013 Giauque ..... A63B 69/0026 473/164
2002/0151386 A1 * 10/2002 Williams ..... A63B 69/0026 473/446
2005/0032580 A1 * 2/2005 Rango ..... A63B 69/3676 473/164
2015/0297967 A1 * 10/2015 Simon ..... A63B 69/0026 473/446

* cited by examiner

*Primary Examiner* — Mark S Graham
(74) *Attorney, Agent, or Firm* — Kyle R. Satterthwaite; Ryan W Dupuis; Ade & Company Inc.

(57) ABSTRACT

A hockey training apparatus features an elongated track, a practice puck carried atop said elongated track and displaceable back and forth therealong on a longitudinal travel path, and at least one rebound mechanism mounted to the track adjacent a respective end of the longitudinal travel path for rebounding of said practice puck back toward an opposing end of the longitudinal travel path upon impact with said rebound mechanism. Each rebound mechanism comprises a resiliently stretchable member spanning laterally cross-wise to the longitudinal travel path in a taut condition thereacross at a location thereabove for impact by the practice puck.

17 Claims, 11 Drawing Sheets

HOCKEY TRAINING APPARATUS WITH NOVEL PUCK REBOUNDERS AND FOLD-UP STORAGE FUNCTION

FIELD OF THE INVENTION

The present invention relates generally to hockey training apparatuses of the type in which a practice puck is displaceable back and forth along a track that again can be rebounded off a rebound mechanism at one or both ends of the track to practice puck handing and shooting skills.

BACKGROUND

Hockey training apparatuses of the forgoing type have been previously proposed in the prior art, for example as exemplified in U.S. Pat. Nos. 4,070,017, 5,161,799 and 6,099,420. The first two of these references disclose single-ended apparatuses of a type having a rebound mechanism at only one end, thus intended to practice shooting along the track in a single predetermined direction therealong toward the singular rebound mechanism. The latter reference discloses a double-ended apparatus having a rebound mechanism at both ends, thus allowing more robust practice of various puck handling techniques.

Each reference uses a compression spring, spring-loaded plunger or rubber block as its rebound mechanism, but such rebound mechanisms may be subject to speed and wear issues.

U.S. Pat. No. 3,955,815 discloses another puck and track training apparatus, but instead of a rebound mechanism against and free-sliding practice puck, employs a tethered practice puck drawn toward one end of the track by a spring-wound cord. The shooter must overcome the resistance of the cord to shoot the puck toward the opposing end of the track, after which the puck is pulled back to the originating end of the track by the spring-wound cord. The reference thus lacks any solution for improving the rebound mechanisms of other prior art references cited above.

Another potential shortcoming of the prior art is that the notable track length of the apparatuses of take up floor space of significant footprint. U.S. Pat. No. 6,099,420 discloses a multi-section track that can be assembled and disassembled for portability. However, the need for disassembly and reassembly between uses does not lend efficient transition from storage to use.

Accordingly, there remains room for improvements and alternatives in the field of rebound-based hockey training apparatuses.

SUMMARY OF THE INVENTION

According to one aspect of the invention, there is provided a hockey training apparatus comprising:

an elongated track;

a practice puck carried on said elongated track and displaceable back and forth therealong on a longitudinal travel path; and at least one rebound mechanism mounted to the track adjacent a respective end of the longitudinal travel path for rebounding of said practice puck back toward an opposing end of the longitudinal travel path upon impact with said rebound mechanism;

wherein each rebound mechanism comprises a resiliently stretchable member spanning laterally cross-wise to the longitudinal travel path in a taut condition thereacross at a location thereabove for impact by the practice puck.

Preferably the resiliently stretchable member of each rebound mechanism comprises a bungee cord.

Preferably the resiliently stretchable member embraces circumferentially around curved peripheral surfaces of two rounded support members disposed on opposite sides of said travel path.

Preferably the rounded support members comprise upper flanges projecting outwardly from said curved peripheral surfaces at locations thereabove to prevent the resiliently stretchable member riding upwardly off said rounded support members.

Preferably the rounded support members comprise lower flanges projecting outwardly from said curved peripheral surfaces at locations therebelow to prevent falling of the resiliently stretchable member downwardly off said rounded support members.

Preferably said rounded support members are pulley sheaves.

Preferably each rebound mechanism comprises a housing in which opposing ends of the resiliently stretchable member are received.

Preferably each rebound mechanism comprises a support structure having a pair of slotted openings through which the resiliently stretchable member extends, and at least one stop that is carried by the resiliently stretchable member and exceeds a size of the slotted openings to limit pulling of the resiliently stretchable member therethrough.

Preferably the resiliently stretchable member has two opposing ends, and said at least one stop comprises two stops, each residing adjacent a respective one of said two opposing ends of the resiliently stretchable member.

Preferably each stop comprises a knot tied in or to said resiliently stretchable member.

Preferably each stop comprises an annular washer disposed around said resiliently stretchable member.

Preferably said support structure comprises a cover fitted over open ends of the slotted openings to prevent slippage of the resilient flexible member from said slotted openings through said open ends thereof.

Preferably there is a pivotal mount attached or attachable at a first end of the apparatus to movably mount said apparatus to a wall or other upright structure for movement between a deployed position reaching outward therefrom along a floor or ground surface, and a storage position standing upright along said wall or other upright structure.

Preferably there is a catch device mounted or mountable on said wall or other upright structure at a spaced elevation above the pivotal mount to selectively secure the apparatus in the storage position by mating with a cooperating catch feature thereon.

According to a second aspect of the invention there is provided a hockey training apparatus comprising:

an elongated track;

a practice puck carried on said elongated track and displaceable back and forth therealong on a longitudinal travel path; and at least one rebound mechanism mounted to the track adjacent a respective end of the longitudinal travel path for rebounding of said practice puck back toward an opposing end of the longitudinal travel path upon impact with said rebound mechanism, each rebound mechanism comprising:

- a pair of rounded support members disposed on opposite sides of said longitudinal travel path and having curved peripheral surfaces;
- a support structure disposed beyond the respective end of the longitudinal path and having a pair of slotted openings therein;

a resiliently stretchable member embraced circumferentially about the curved peripheral surfaces of the rounded support members in a stretched taut position spanning therebetween across the longitudinal travel path and reaching onwardly from each rounded support member through a respective one of the slotted openings in the support structure; and stops carried on the resiliently stretchable member adjacent opposing ends thereof residing respectively behind the slotted openings of the support structure to block sliding of said ends of the resiliently stretchable member therethrough and thereby maintain the stretched taut position of the resiliently stretchable member across the longitudinal travel path.

According to a third aspect of the invention there is provided a hockey training apparatus comprising:

an elongated track;

a practice puck carried on said elongated track and displaceable back and forth therealong on a longitudinal travel path;

at least one rebound mechanism mounted to the track adjacent a respective end of the longitudinal travel path for rebounding of said practice puck back toward an opposing end of the longitudinal travel path upon impact with said rebound mechanism; and a pivotal mount attached or attachable at a first end of the apparatus to movably mount said apparatus to a wall or other upright structure for movement between a deployed position reaching outward therefrom along a floor or ground surface, and a storage position standing upright along said wall or other upright structure.

BRIEF DESCRIPTION OF THE DRAWINGS

One embodiment of the invention will now be described in conjunction with the accompanying drawings in which.

DETAILED DESCRIPTION

Figure 1:
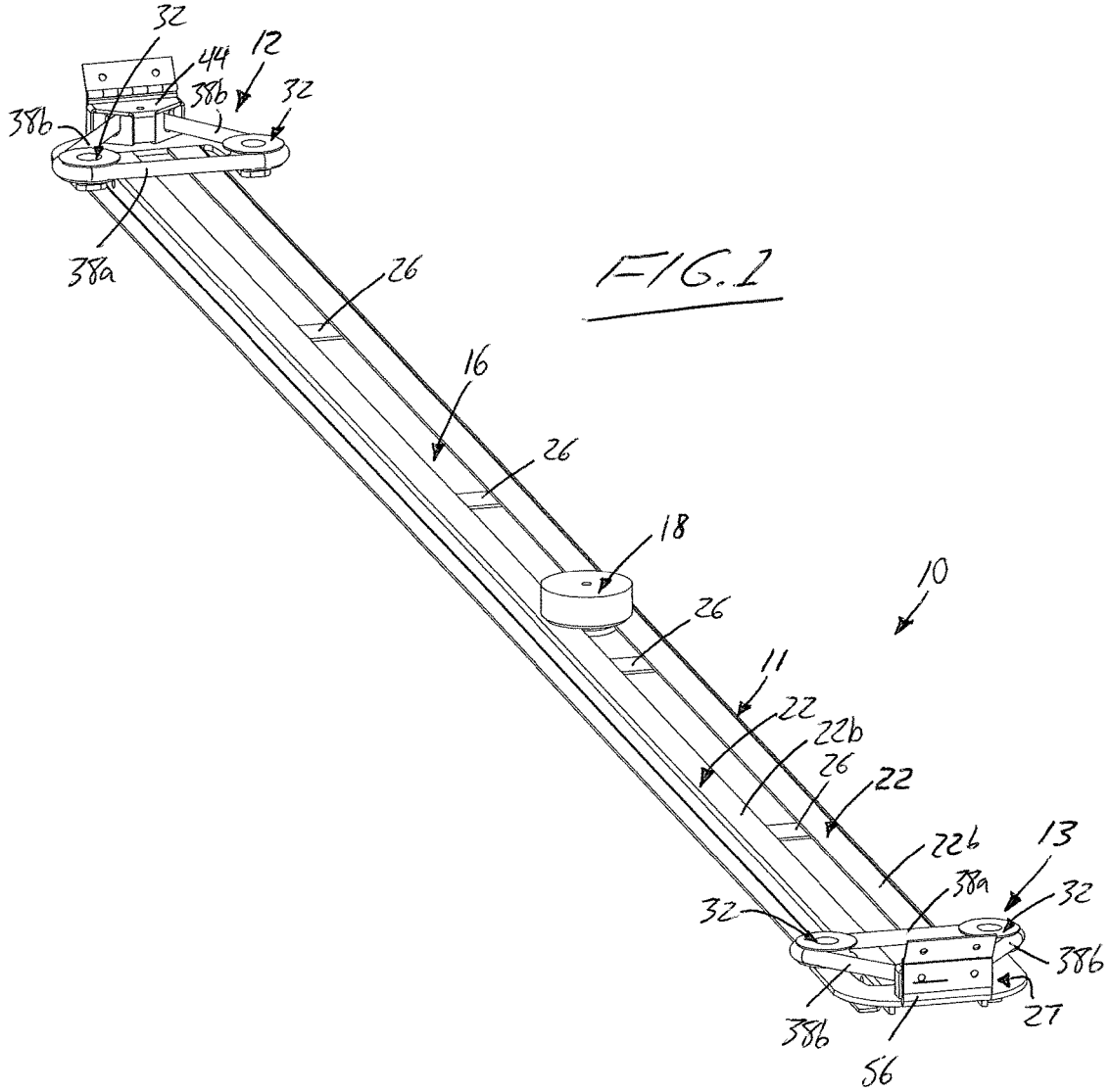
FIG. 1 is a top perspective view of a hockey training apparatus of the present invention.
Figure 2:
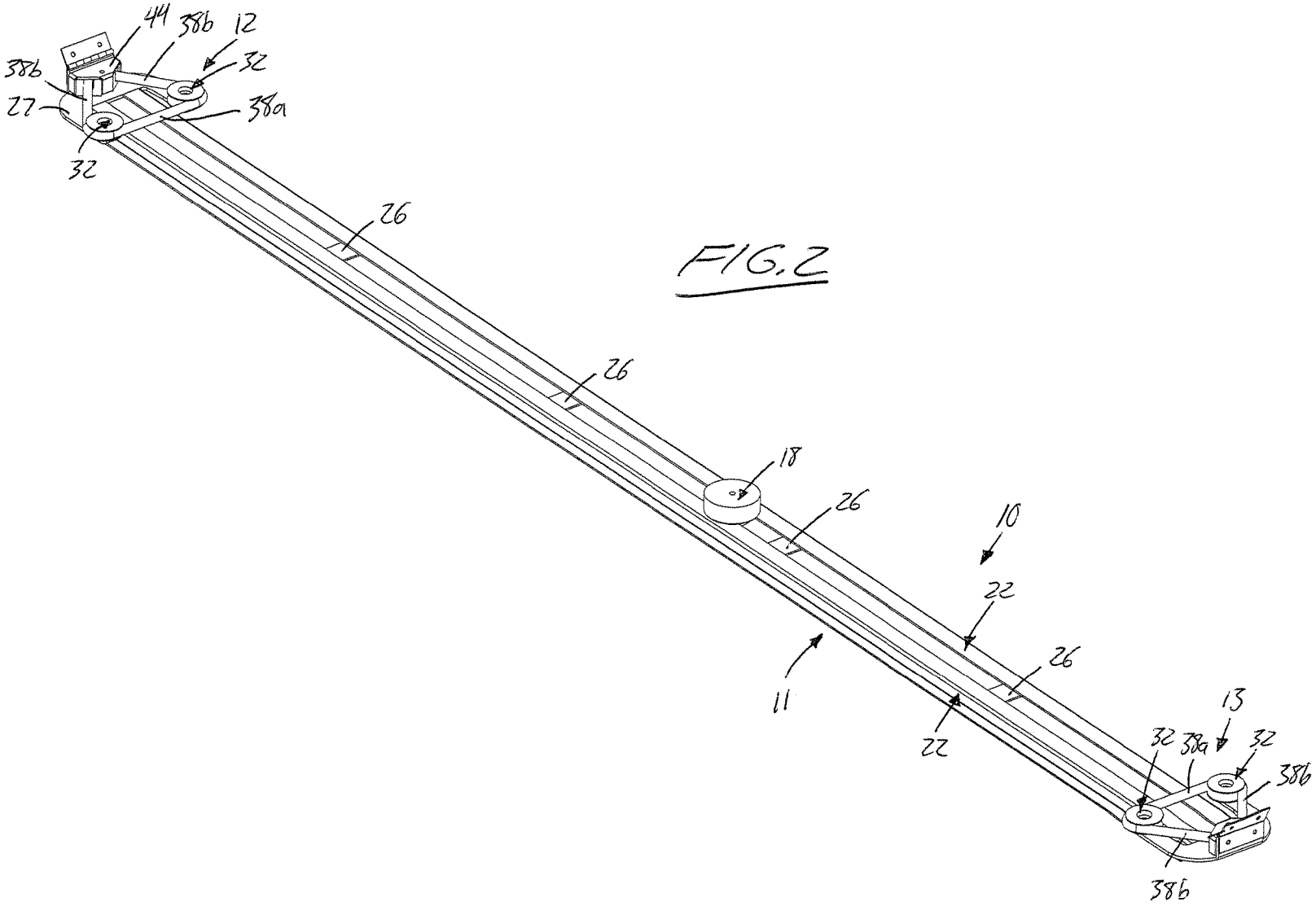
FIG. 2 is another top perspective view of the apparatus of FIG. 1.
Figure 3:
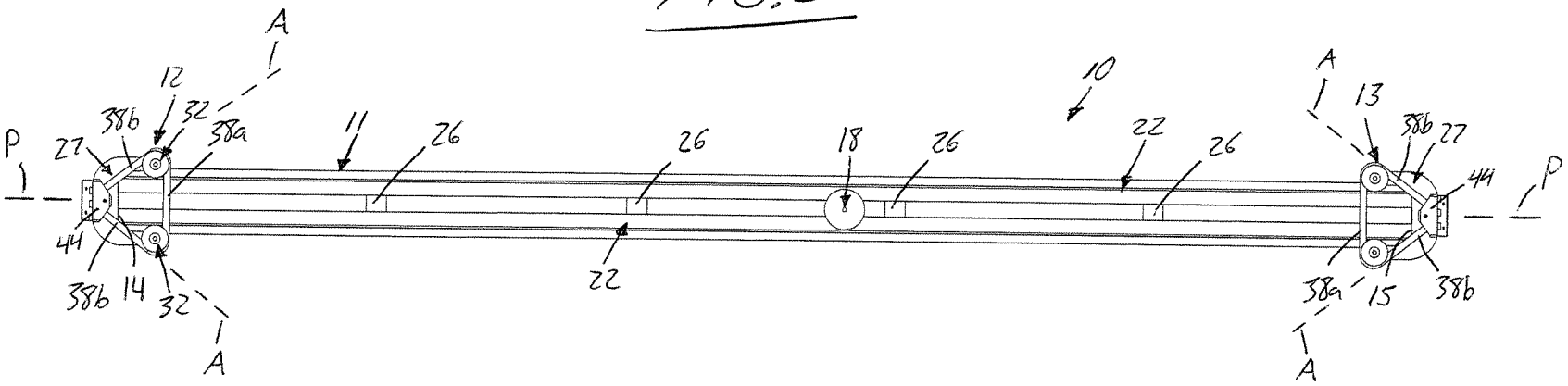
FIG. 3 is an overhead plan view of the apparatus of FIG. 1.
Figure 4:
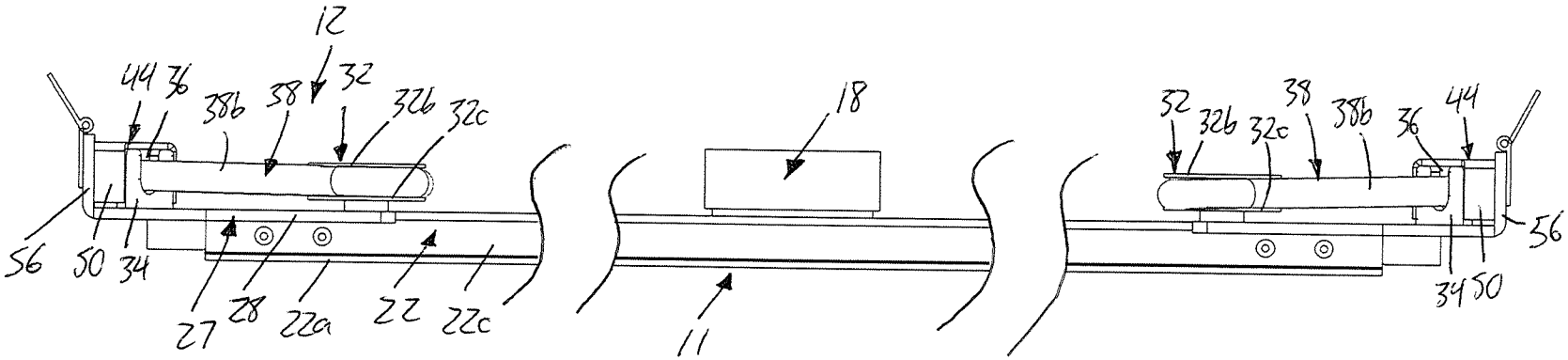
FIG. 4 is a side elevational view of the apparatus of FIG. 1.

The drawings show a double-ended hockey training apparatus 10 of the present invention featuring an elongated track 11 having identical rebound mechanisms 12, 13 respectively mounted at the opposing ends 14, 15 of the track 11. The ends of the track are separated in a longitudinal direction thereof, and the track features a longitudinally oriented slot 16 running fully from one end of the track to the other to define a longitudinal travel path over which a practice puck 18 is displaceable back and in linear fashion along this longitudinal path of the track 11.

Figure 5:
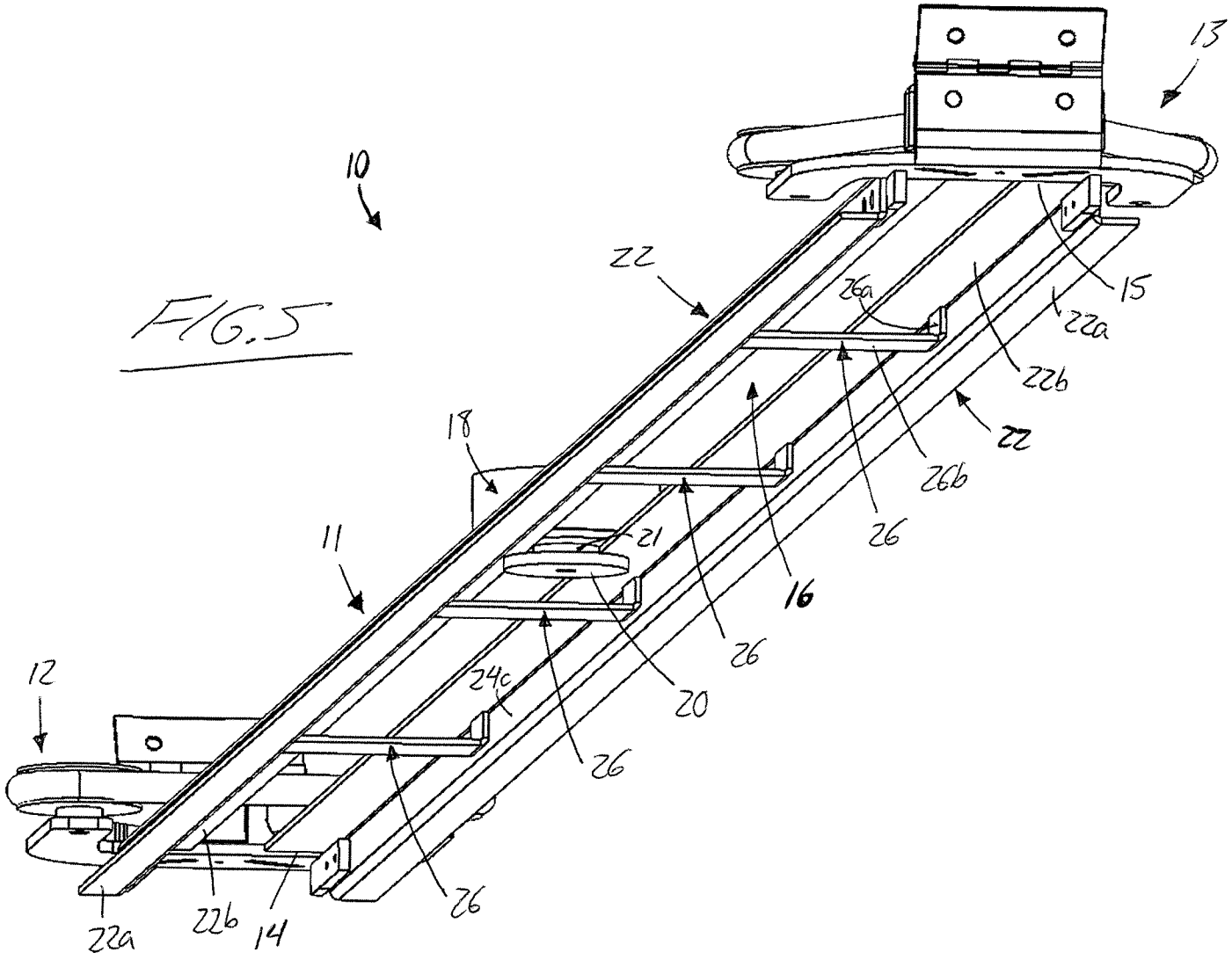
FIG. 5 is bottom perspective view of the apparatus of FIG. 1.
Figure 6:
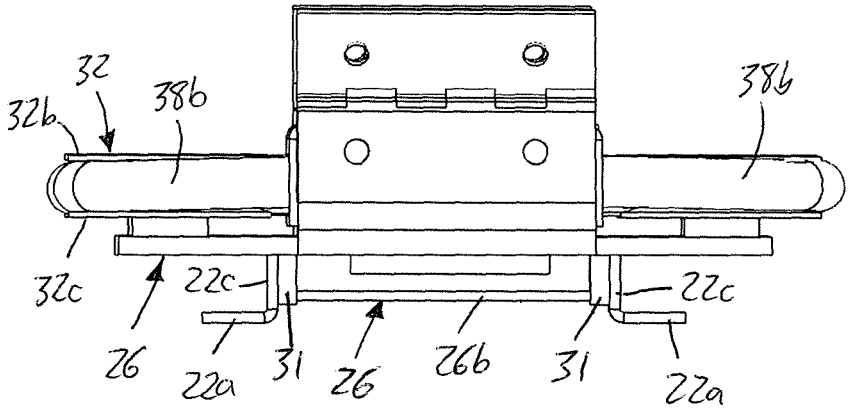
FIG. 6 is an end elevational view of the apparatus of FIG. 1.

As shown in FIG. 5, the puck 18 of the illustrated embodiment is carried on a disc-shaped base 20 that resides under the slot 16 of the track. An upright stem 21 stands atop the base 20 and reaches upwardly through the slot 16 to connect to the underside of the puck 18, which features a low friction plate or coating to enable smooth sliding movement of the puck along the track. The track of the illustrated embodiment is assembled from two Z-channel track members 22 whose lower legs 22*a* lie horizontally coplanar with one another in a bottom plane of the track for seating on a flat ground or floor surface, and whose upper legs 22*b* lie horizontally coplanar with one another on opposite sides of the slot 16 in a top plane of the track atop which the puck 18 slides back and forth. The Z-channel track members 22 lie parallel to one another, but face oppositely of one another so that their upper legs 22*b* reach inwardly toward one another, while the lower legs 22*a* project outwardly away from one another to increase the base footprint of the track to lend lateral stability thereto. At spaced intervals along the track's longitudinal direction, a series of bridging members 26 interconnect the two track members 22 and maintain a fixed distance between them in a lateral direction lying perpendicular to the longitudinal direction, thus maintaining the open slot 16 between the two track members at the top plane of the track. Each bridging member 26 has upturned ends 26*a* respectively affixed to the vertically upright legs 22*c* the track members 22, 24, and a horizontal central span 26*b* interconnecting the upturned ends 26*a* in spaced relation below the upper legs 22*b* of the track members 22, at an elevation near the bottom plane occupied by the lower legs 22*a* of the track members. This spaced relation between the upper track member legs 22*b* and the central spans 26*b* of the bridging members 26 provides sufficient vertical clearance therebetween to accommodate the sliding movement of the puck base 20 along the underside of the track slot 16.

In other embodiments, the track may be modified to define an elongated channel beneath the slot 16, by which a wheeled carriage can longitudinally traverse the track from end to end thereof inside the channel and carry the puck atop the wheeled carriage via an upright stem passing through the slot. One example of a track and carriage configuration of this type is as disclosed in aforementioned U.S. Pat. No. 4,070,017. The displacement of the puck back and forth along the track thus may be enabled by a surface-to-surface sliding interface, like that of the presently illustrated embodiment, or a wheel-to-surface rolling interface like that of the aforementioned U.S. patent.

Figure 10:
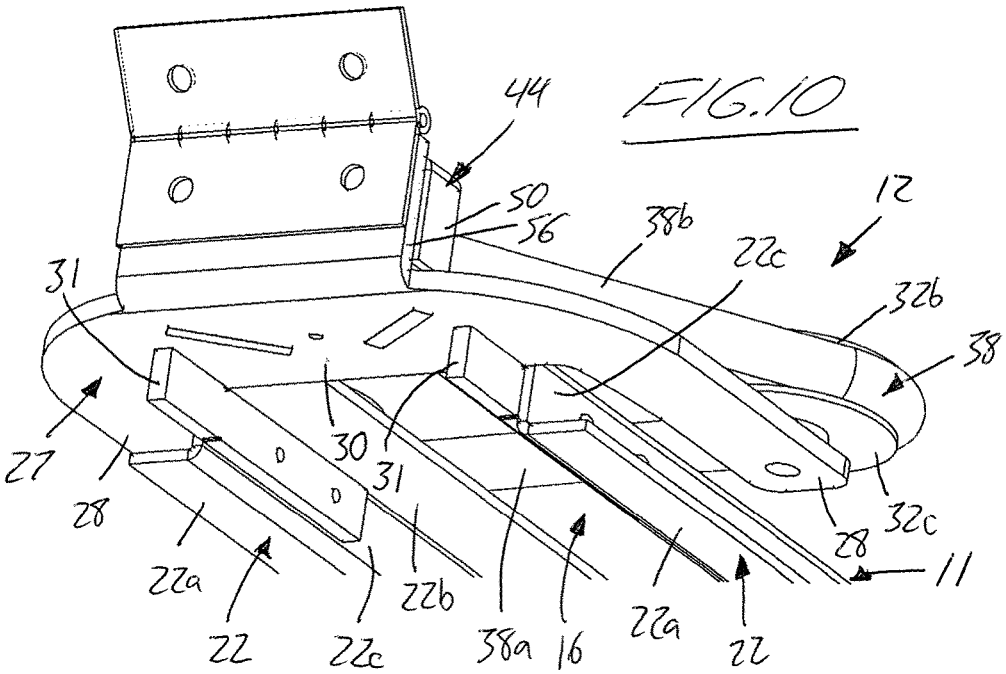
FIG. 10 is a bottom perspective view of the rebound mechanism of FIG. 9.

The two rebound mechanisms 12, 13 are identical to one another, differing only in that they resided in mirrored mounting orientations so as to face toward one another from their respective ends of the track 11. Accordingly, any description made herein of one rebound mechanism likewise applies to the other. Each rebound mechanism features a U-shaped mounting plate 27 that embraces externally around the two track members 22 at the respective end of the track. The U-shaped mounting plate 27 thus has two outboard legs 28 lying parallel and coplanar with the upper legs 22*a* of the track members 22 in outboard relation thereto on opposite sides of the slot-defined longitudinal path of the track. A central span 30 of the U-shaped mounting plate 27 joins the two outboard legs 28 together in coplanar relation therewith across the respective end of the track 11. As best seen in FIG. 10, the mounting plate is carried on the track 11 by two extension bars 31 affixed to the upright legs 22*c* of the two track members 22 in positions extending beyond the ends thereof beneath the central span 30 of the mounting plate 27, which is affixed atop these extension bars 31.

Each outboard leg 28 of the mounting plate 27 has a rounded support member 32 mounted thereatop near a distal end of the outboard leg 28 furthest from the central span 30. Each rounded support member 32 thus resides at a distance spaced longitudinally inward from the respective end 14, 15 of the track. In the illustrated embodiment, each rounded support member 32 is a pulley sheave bolted horizontally atop the mounting plate 27, whereby the support member has a recessed peripheral surface 32*a* spanning a full 180-degree curvature about a central upright axis of the sheave. This recessed peripheral surface 32*a* resides between two flanges, namely a horizontal upper flange 32*b* jutting radially outward from the peripheral surface 32*a* at a location therebove at the top of the member 32, and a horizontal lower flange 32*c* jutting radially outward from the peripheral surface 32*a* at a location therebelow above the topside of the mounting plate 27.

Figure 7:
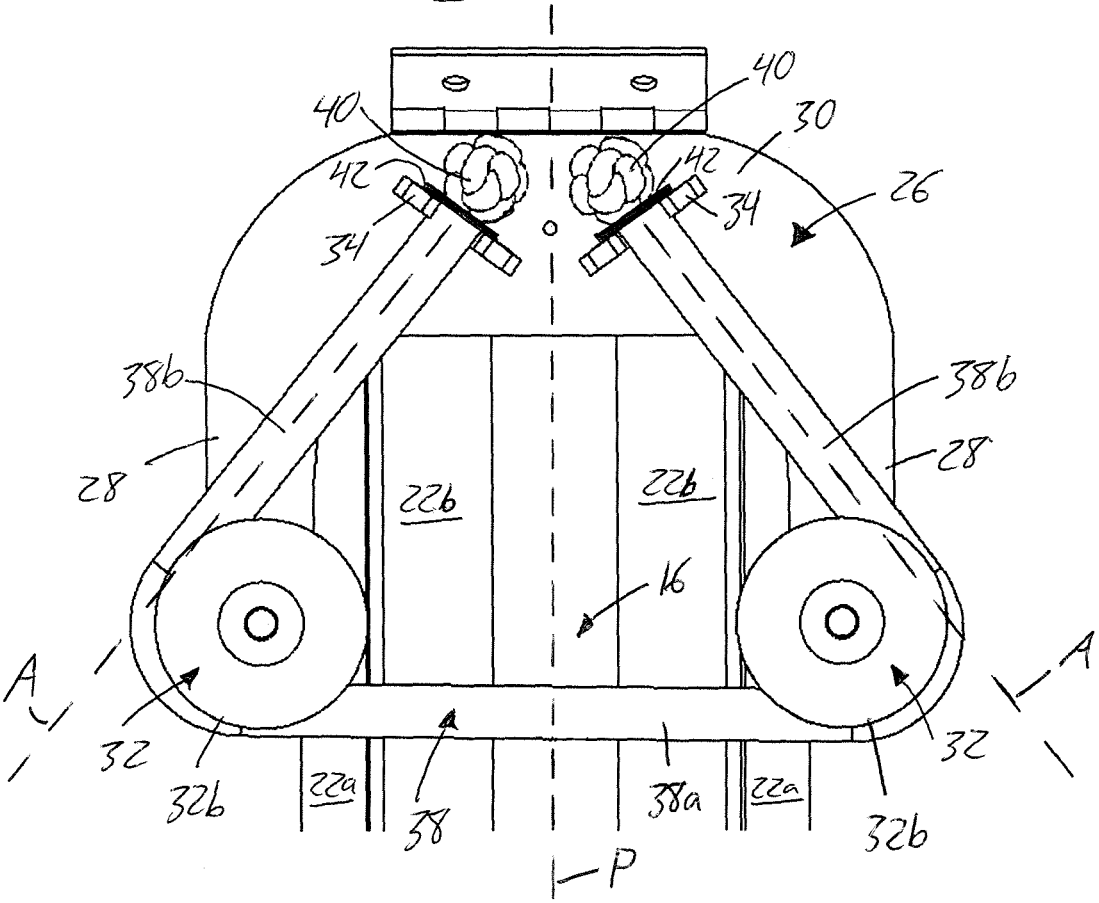
FIG. 7 is a partial overhead plan view of the apparatus of FIG. 1, showing one of two rebound mechanisms of the apparatus with a cover of the mechanism removed for illustrative purposes.
Figure 8:
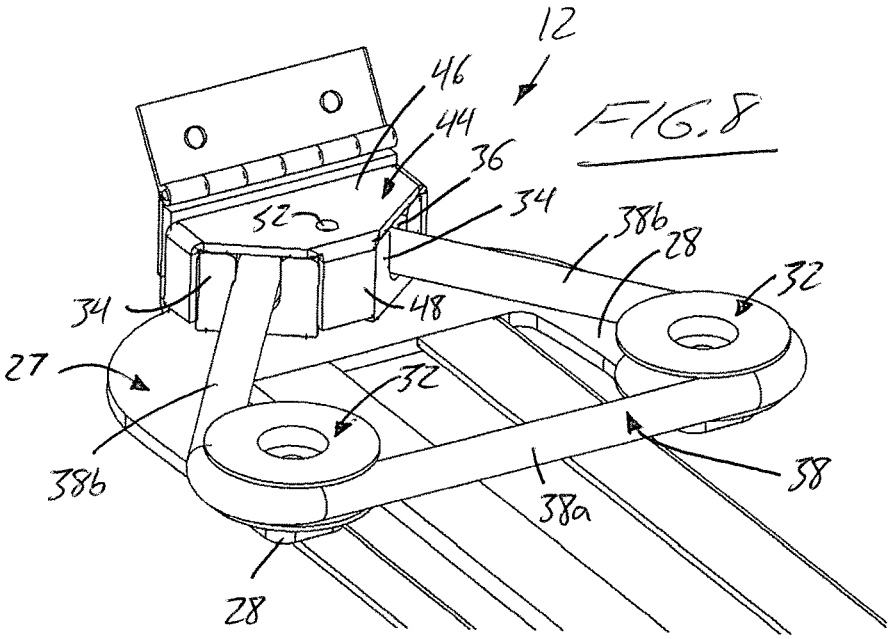
FIG. 8 is a top perspective view of the rebound mechanism of FIG. 7 in a fully assembled state with the cover thereof installed.

On the central span 30, two upright support walls 34 stand vertically upward from the mounting plate 27 in perpendicular relation thereto. With reference to FIG. 7, the two support walls 34 reside symmetrically of one another across a midplane P of the apparatus that cuts longitudinally, vertically and centrally through the slot 16 of the track. Likewise, the track members 22, the round supports 32 and the outboard legs 30 of the mounting plate 27 are arranged in symmetric pairs across this midplane P. Each support wall 34 lies obliquely of the midplane P so that the two support walls 34 converge inwardly toward the end of the track adjacent which they reside and diverge outwardly away from said end of the track. Each support wall 34 resides closer to the midplane of the apparatus than to the respective round support 32 on the same side of said midplane P. Each support wall 34 has a slotted opening 36 that cuts downwardly into the support wall 34 from the upper end thereof opposite the mounting plate 27.

A bungee cord 38 or other similar elongate, flexible, resiliently stretchable member (e.g. a resiliently stretchable belt) is wrapped on a generally triangular path embracing circumferentially around the curved peripheral surfaces of the two round supports 32 and passing through the slotted openings 36 in the support walls 34. A reference axis A passing perpendicularly through the plane of each support wall 34 at the slotted opening 36 therein lies tangentially of the respective round support on the same side of the midplane. Accordingly, the bungee cord 38 has a central span 38*a* spanning perpendicularly through midplane P across the longitudinal path of the track in a close elevation thereabove between the two round supports 32 at a location near but inward from the respective end of the track, and two converging spans 38*b* angling inwardly toward the midplane P of the apparatus in the aforementioned tangential direction of references axes A so as to pass linearly from the rounded support members 32 through the slotted openings 36 of the support walls 34 toward a convergence point of said axes situated beyond the respective end of the track.

As schematically shown in FIG. 7, behind the support walls on the outer sides thereof facing away from the round supports, the two ends of the bungle cord are tied into knots 40, and a respective annular washer 42 is disposed around the bungle cord near each end thereof between the respective knot 40 and the respective support wall 34. The diameter of the knot 40 exceeds the cord diameter, the width of the slotted opening 36 in the support wall 34 and the inner diameter of the washer, and the outer diameter of the washer 42 exceeds with the width of the slotted opening 36 in the support wall 34. The knots and washers thus define enlarged stops carried on the bungee cord 38, by which pulling of the cord's ends through the slotted openings 36 of the support walls 34 is prevented.

The bungee cord 38 is one whose relaxed length in an unstretched state is insufficient to fullfill the generally triangular path around the rounded supports 32 and through the support walls 34. As a result, installation of the cord 38 involves lengthwise stretching thereof to accomplish the installed position embraced around the rounded supports 32 and engaged through the slotted openings 36 of the support walls 34. This way, the central span 38*a* of the installed bungee cord 38 is stretched taut across the longitudinal path of the track during installation of the cord, and this taut condition is maintained by the stop washers 42 and knots 40 that prevent the ends of the cord from being pulled through the support walls 34. It will be appreciated that the knots 40 alone may be sufficient without the addition of the washers 42, or that other forms of enlargement on the bungee cord may be used at or near the ends thereof, for example in the form of any available end-fitting capable of sufficiently secure attachment to such cord.

Figure 9:
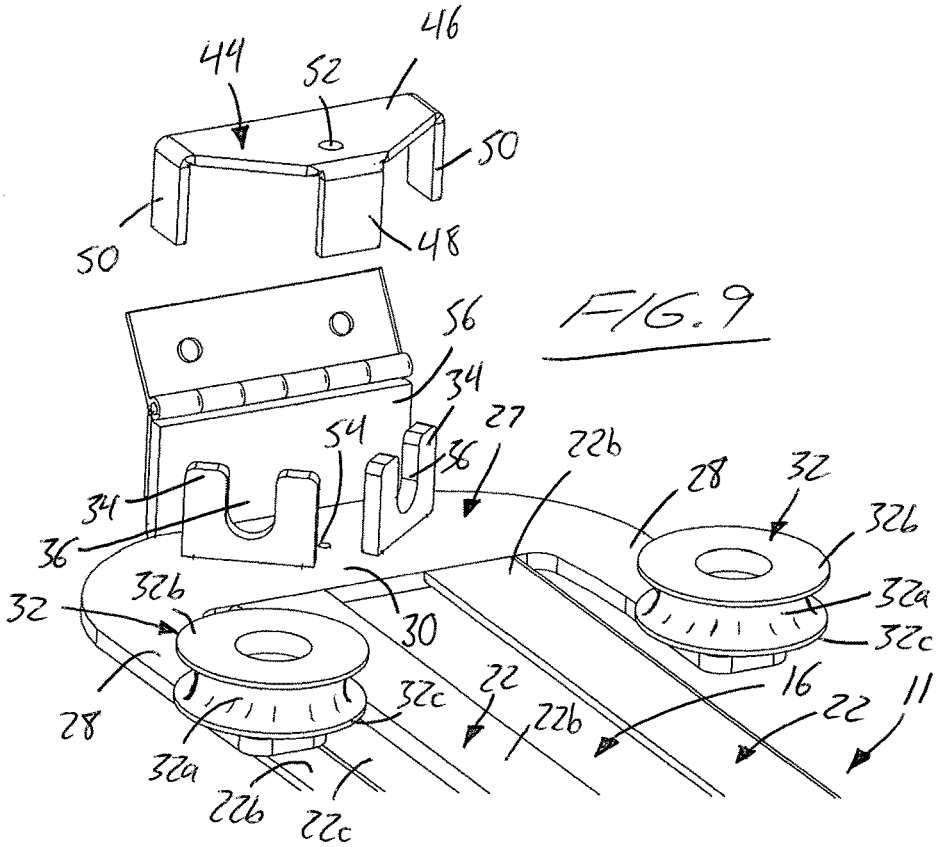
FIG. 9 is a top perspective view of the rebound mechanism of FIG. 8 with the cover thereof in an exploded position and with a bungee cord of the mechanism removed.

To prevent the cord 38 from slipping out of either slotted opening 36 through the open top end thereof, a removable cover 44 is installed over the two support walls 34 to close off the top ends of the slotted openings 36 above the installed bungee cord 38. The cover 44, shown in an exploded position prior to installation of the cord and cover in FIG. 9, features a top wall 46 of generally triangular shape having three downturned legs situated at the three corners thereof to stand atop the mounting plate 27. A central downturned leg 48 of the cover resides in intersecting relationship with the midplane P between the converging inner ends of the support walls 34, while two outboard legs 50 of the cover are situated further outward from the midplane P to reside adjacent the diverging outer ends of the support walls 34. A fastener hole 52 in the top wall 46 of the cover 44 aligns with a matching fastener hole 54 in the central span 30 of the mounting plate 27 to enable securement of the cover 44 over the support walls 34 by a threaded fastener removably engaged in said fastener holes.

In the illustrated embodiment, each rebound mechanism 12, 13 further includes a vertical outer wall 56 standing perpendicularly upward from the central span 30 of the mounting plate 27 behind the support walls 34 at an outer edge of this central span 30 furthest from the nearest end of the track 11. The outboard legs 50 of the cover 44 fully span the distance from the divergent outer ends of the support walls 34 to the outer wall 54, while the central leg 48 of the cover 44 spans the full distance between the convergent inner ends of the support walls 34. The support walls, cover and outer wall thus form a housing in which the knotted ends of the bungee cord 38 are fully contained once the cover 44 has been installed during assembly of the apparatus.

If or when required, replacement of the bungee cord 38 is enabled by simple unfastening and removal of the cover 44, lifting of the bungee cord 38 from the slotted opening 36 of one support wall 34, thereby releasing the tensioned state of the cord 38 so that it can be unwrapped from around the rounded supports 32 and lifted from the slotted opening 36 of the other support wall 34. Alternatively, one can remove the bungee cord 38 by first pulling the central span 38*a* of the cord longitudinally away from the nearest end of the track (i.e. toward the other rebound mechanism at the other end of the track) to further stretch the bungee cord by a sufficient amount to pull it out of the recessed periphery 32*a* of the rounded supports 32 and over the upper flanges 32*b* thereof to relieve the tensioned state of the cord 38, whereupon the cover 44 can then be removed to enable withdrawal of the cord 38 from the slotted openings 36 of the support walls 34.

Installation of a new cord is likewise easily performed by, with the cover removed, lowering the cord 38 into one of the slotted openings 36, routing the cord around the two rounded supports 32, and pulling the second end of the cord over the slotted opening 36 in the other support wall 34 to stretch the cord past the support wall, followed by lowering of the cord 38 down into the second slotted opening 36 and placement and fastening of the cover 44 in its installed position over the support walls 34. Alternatively, with the cover 44 removed, one can initially lower both end-adjacent areas of the cord 38 down into the two slotted openings 36, and then pull the central span 38*a* of the cord into stretch relation over the two rounded supports 32 at the sides thereof opposite the support walls 34, where release of the cord 38 will allow partial relaxation thereof into a tightened position against the curved peripheries 32*a* of the rounded supports 32, while leaving enough tension in the cord 38 to keep it taut between the two rounded supports 32.

During use of the apparatus, the puck can be displaced in either direction along the longitudinal travel path by the user's hockey stick in order to drive the puck 18 against a selected rebound mechanism, where the central span 38*a* of the bungee cord 38 will be deflected by the puck impact toward the nearest end of the track, thus momentarily stretching the bungee cord 38 even further than its normally tensioned state maintained by the capture of the cord ends in the slotted support walls. After impact, this central span 38*a* of the bungee cord 38 snaps back toward its normal position spanning linearly between the two rounded supports 32, which thus rebounds the puck back toward the other end of the track 11. This flexing and stretching of a resiliently stretchable cord, belt, cable, band or other elongated member offers reduced mechanical noise compared to the axial collapse and expansion of coil springs rebounders, and also may reduce noise compared to a rubber block rebounder where only minor surface deflection occurs on impact, thus absorbing less impact energy.

The overall wear life of the rebound mechanism is also believed to be an improvement over those of the prior art, particularly where rounded supports 32 with curved peripheries of notable notable diameter (preferably exceeding 0.5-inch, and more preferably exceeding 1.0-inch) are used to provide a contact area of notable size and smooth conformity with the cord, thereby helping spread out impact forces. While the illustrated embodiment is described as employing pulley sheaves with upper and lower flanges as the rounded supports 32, they need not be rotatably mounted (i.e. need not form a functional pulley) and may be fixed in place in non-rotatable condition. Additionally, the lower flange 32*c* may optionally be omitted, with reliance instead being made on the mounting plate 27 beneath the rounded support 32 to prevent downward sliding of the cord 38 therefrom. In the illustrated embodiment, the rounded supports 32 are U-groove pulley sheaves whose peripheral surfaces are concavely contoured in cross-sectional planes containing and radiating from the central upright axis of the sheave, thus improving the area of conforming contact with the round shape of the bungee cord. However, it will be appreciated that that rounded supports 32 whose curved periphery is flat in these radial cross-sectional planes may alternatively be used.

While in the illustrated embodiment, the overall support structure by which the cord 38 is supported in its tensioned state is formed by the two rounded supports 32, two slotted support walls 34 and cooperating cover 44, it will be appreciated that the support structure may be varied within the scope of the present invention. For example, while the support plates 34 in the illustrated embodiment lie obliquely of the midplane P and laterally inward from the rounded supports 32, other embodiments may have the support walls 34 lying perpendicular to the midplane P at positions placed further outboard therefrom so that reference axes A of the are parallel non-convergent axes that are tangential with the rounded supports 32 at a most outboard circumferential point thereon. So while FIG. 7 shows the reference axis A on the left as being tangential to the left rounded support 32 at a roughly ten o'clock position thereon and the reference axis A on the right as being tangential to the right rounded support 32 at a roughly two o'clock position thereon, other embodiments may have one or more support plates lying perpendicularly of the midplane P with their reference axes A being tangential of the rounded supports 32 at nine and three o'clock positions thereon. In such embodiments, there may be a singular support wall having both slotted openings 36 therein, or two individual support walls 34 each having a respective slotted opening 36 therein like the illustrated embodiment. One potential advantage, the obliquely oriented, inwardly located support walls of the illustrated embodiment cause the cord to span a greater circumferential fraction of each rounded support for greater contact area therewith.

It will also be appreciated that the support structure need not define an enclosed housing in which the cord ends are contained, as the cover ma be replaced with an alternative means for preventing escape of the inserted cord, for example using a selectively openable and closable latch at each slot to selectively lock the cord therein. Though inclusion of a cover, latch or other means for selective closing of the the slotted opening is preferable in the interest of safety, the scope of the present invention is not specifically limited to the inclusion of any such slot-closure means, which therefore may be omitted in other embodiments.

Figure 11:
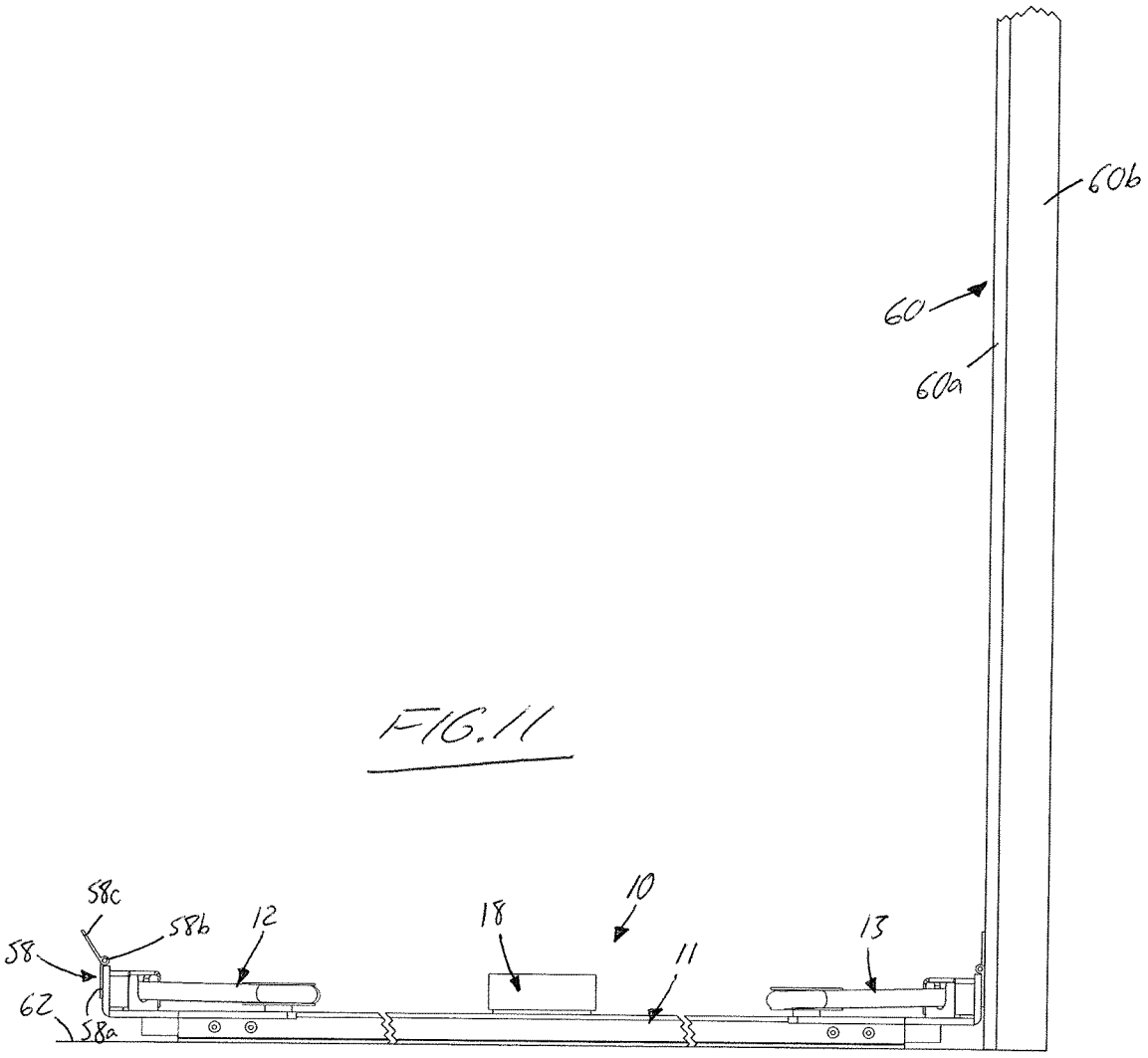
FIG. 11 is a side elevational view illustrating wall-mounted installation of the apparatus of FIG. 1, and showing the apparatus in a deployed position folded down from the wall for use.

The illustrated embodiment includes a respective hinge 58 mounted to the outer wall 56 of the housing of each rebound mechanism. A first leaf 58*a* of the hinge is affixed to the outer wall 56, and the knuckle 58*b* of the hinge runs along the top edge of the outer wall 56 to define a horizontal pivot axis about which a second leaf 58*c* of the hinge can swing relative to the outer wall 56. FIG. 11 shows the apparatus 10 in a wall-mounted installation, where one end of the apparatus is abutted up against the finished interior surface 60*a* (e.g. painted drywall, wall paneling, wall tile, etc.) of a wall structure, and the second leaf 58*c* of the respective hinge 58 at this end of the apparatus is fastened to the wall structure, preferably being screwed into a wall stud 60*b* that underlies the finished interior wall surface 60*a*, though drywall anchors or toggle bolts of sufficient strength may alternatively be used if direct stud-fastening is not available at the intended wall installation site.

Figure 12:
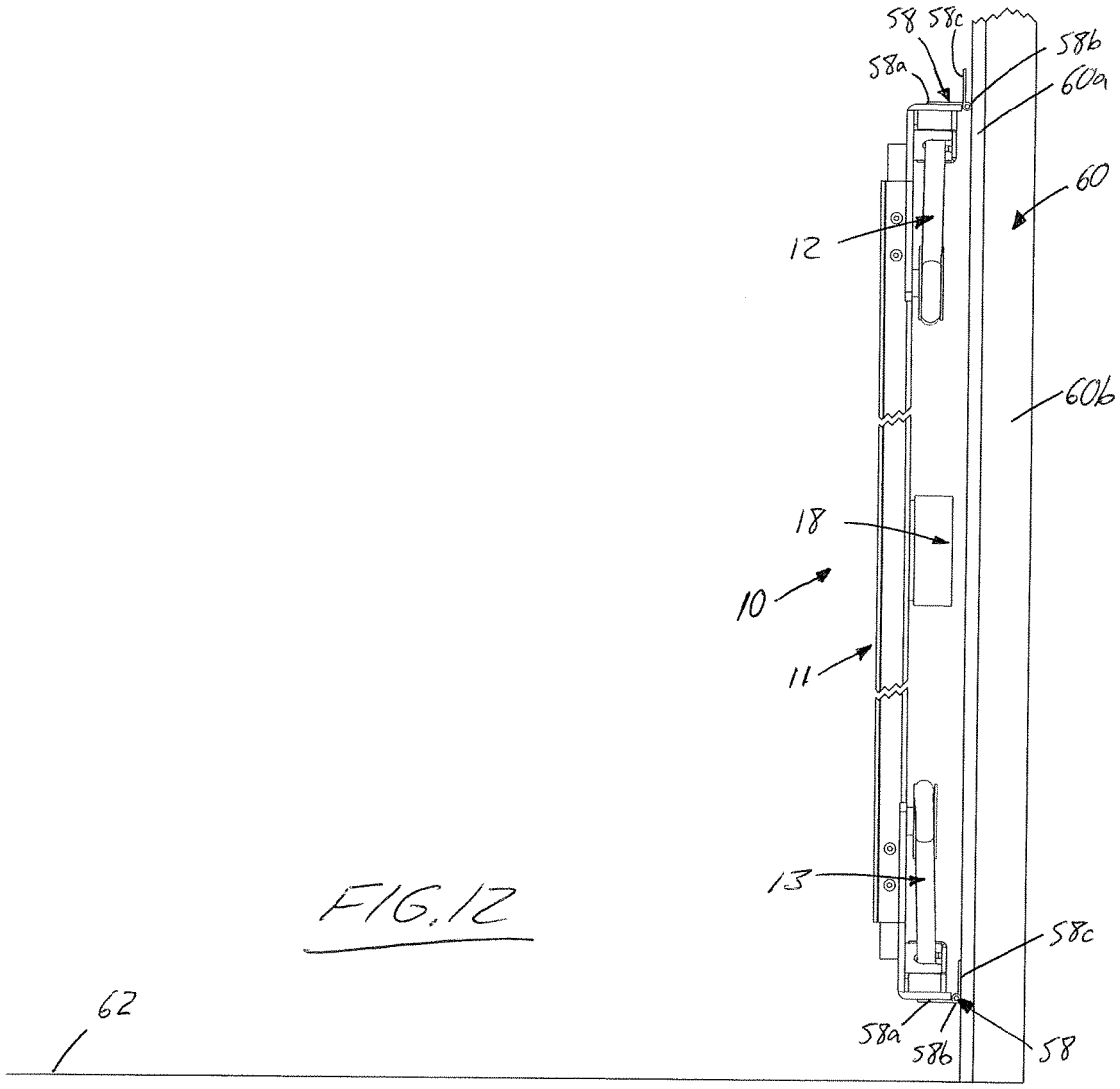
FIG. 12 is a side elevational view of the apparatus of FIG. 11 in a folded-up storage position against the wall.
Figure 13A:
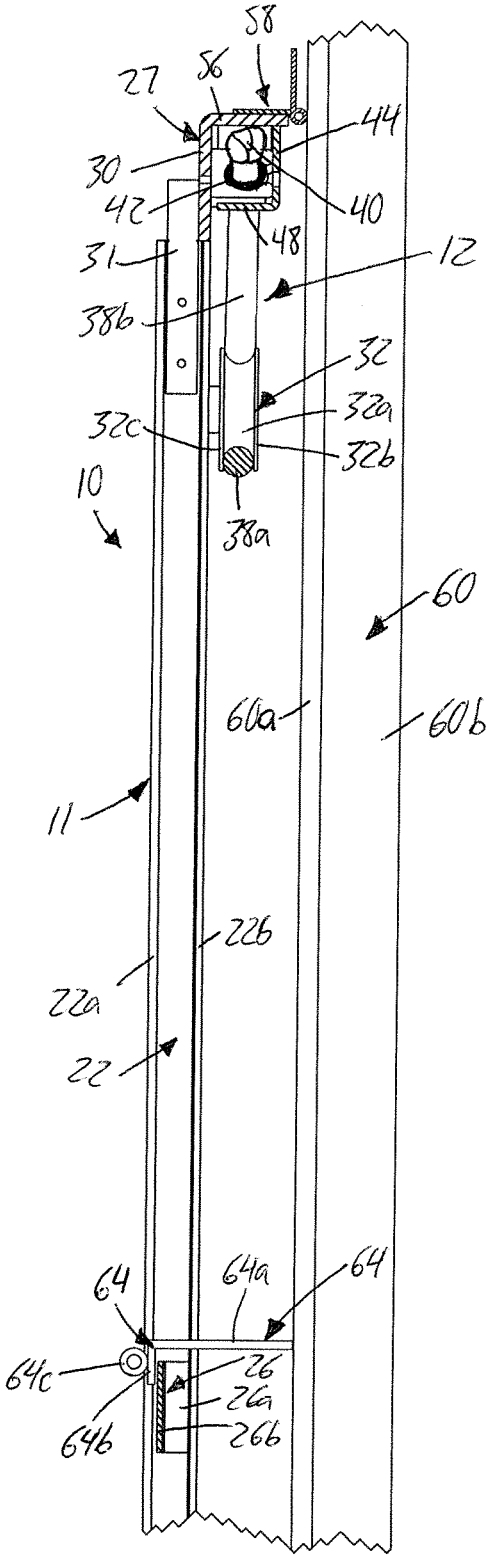
FIG. 13A is a partial closeup and vertically cross-sectioned view of the apparatus of FIG. 12 with a wall-mounted catch in an engaged position therewith to secure the apparatus in the folded-up storage position.
Figure 13B:
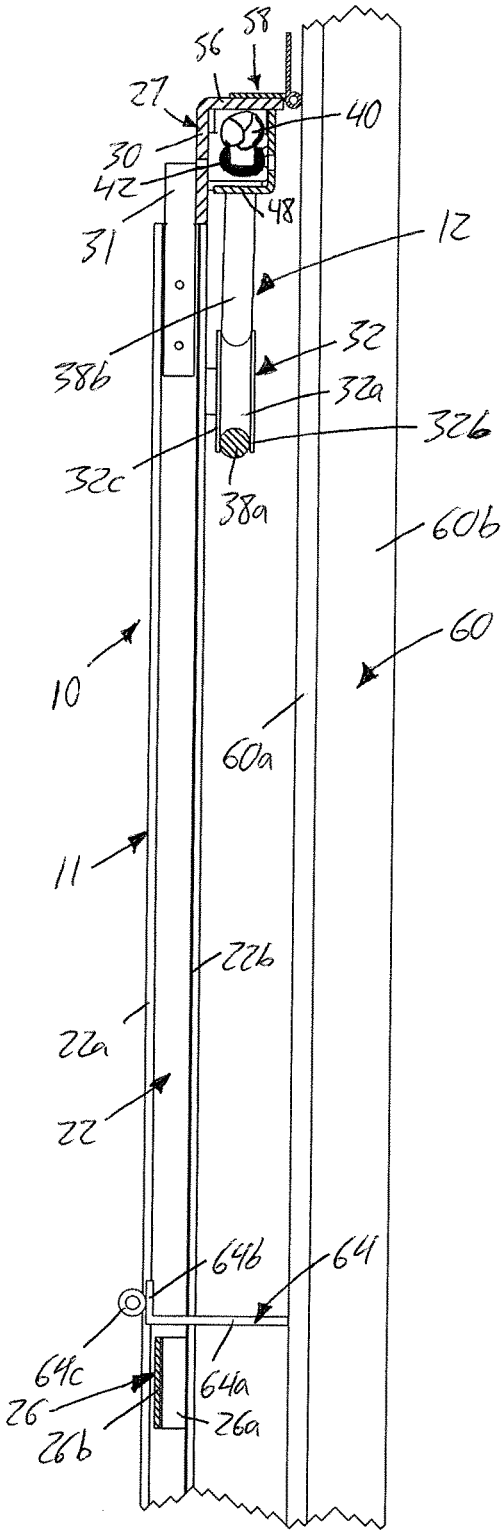
FIG. 13B is another view of the apparatus and wall-mounted catch of FIG. 13A, but with the catch in a disengaged position allowing release of the apparatus from the folded-up storage position.

FIG. 11 shows the wall-mounted apparatus 10 in a deployed position in which the track 11 extends perpendicularly outward from the wall structure in a horizontally seated position atop a ground or floor surface 62 from which the wall structure 60 stands erect. The wall-mounted hinge allows the apparatus 10 to be folded up into an upright storage position shown in FIG. 12, where the track 11 reaches vertically upward along the wall surface 60*a* in slightly spaced relation therefrom, with the puck 18 residing between the track 11 and the wall surface 60*a*. Referring to FIG. 13, a catch device 64 is mounted to the wall structure 60 at a location aligned over the wall-mounted hinge of the apparatus 10. The catch device 64 is selectively engagable with a corresponding catch feature on the training apparatus 10 to securely hold the training apparatus in the folded-up storage position. In the illustrated embodiment, the catch device is a generally L-shaped wall hook having a stem protruding 64*a* protruding outward from the wall, and a hook tab 64*b* projecting perpendicularly to one side of the stem at a distal end thereof furthest from the wall. Via a grip handle 64*c* on the hook tab, the hook tab can be rotated between an engaged securing position shown in FIG. 13A, and a disengaged release position shown in FIG. 13B. In the engaged securing position, the hook tab 64*b* hooks downwardly over the central span 26*b* of one of the bridging members 26 of the track 11 to prevent the training apparatus 10 from swinging outwardly away from the wall. In the disengaged release position, the hook tab is turned upwardly away from the bridging member 26 to release the track from the wall to allow swinging of the training apparatus down into deployed position.

While the illustrated embodiment uses one of the bridging members 26 of the track 11 as a catch feature to be engaged by the wall-mounted catch device, other embodiments may have the catch device engage a different portion of the training apparatus. Where a bridging member is used as the catch feature, it is preferably the uppermost one of the bridging members that resides nearest the free end of the training apparatus opposite the wall-mounted end thereof. The style of catch device and its mode of engagement with the training apparatus may also vary, and may for example use a wall mounted strap that is selectively closed around the bridging member or other catch feature of the training apparatus, or a strap mounted on the apparatus and selectively placeable over a fixed wall hook.

While described as mounted to a wall structure, the apparatus may likewise be movably mounted to any upright structure. Non-limiting examples of such upright structures include, columns, pillars, poles, storage racks, exercise equipment framing, etc. The illustrated embodiment features two hinges 58, one at each end of the apparatus, whereby either hinge 58 can serve as a pivotal mount attachable to the upright structure 60. However, in other embodiments, a pivotal mount may be provided at only one end, which therefore becomes a dedicated mounting end of the apparatus.

While the illustrated embodiment is a double-ended hockey training apparatus with two rebound mechanisms at opposing ends of the track, it will be appreciated that the unique rebound mechanism design and fold-up mounted installation option disclosed herein may likewise be employed on single-ended hockey training apparatuses with a singular rebound mechanism at only one end thereof.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A hockey training apparatus comprising:

an elongated track;

a practice puck carried on said elongated track and displaceable back and forth therealong on a longitudinal travel path; and flang at least one rebound mechanism mounted to the track adjacent a respective end of the longitudinal travel path for rebounding of said practice puck back toward an opposing end of the longitudinal travel path upon impact with said rebound mechanism;

wherein each rebound mechanism comprises a resiliently stretchable member spanning laterally cross-wise to the longitudinal travel path in a taut condition thereacross; and wherein each rebound mechanism comprises a support structure having a pair of slotted openings through which the resiliently stretchable member extends, and at least one stop that is carried by the resiliently stretchable member and exceeds a size of the slotted openings to limit pulling of the resiliently stretchable member therethrough.

2. The apparatus of claim 1 wherein the resiliently stretchable member of each rebound mechanism comprises a bungee cord.

3. The apparatus of claim 1 wherein the resiliently stretchable member embraces circumferentially around curved peripheral surfaces of two rounded support members disposed on opposite sides of said travel path.

4. The apparatus of claim 3 wherein the rounded support members comprise upper flanges projecting outwardly from said curved peripheral surfaces at locations thereabove to prevent the resiliently stretchable member riding upwardly off said rounded support members.

5. The apparatus of claim 3 wherein the support members comprise lower flanges projecting outwardly from said curved peripheral surfaces at locations therebelow to prevent falling of the resiliently stretchable member downwardly off said rounded support members.

6. The apparatus of claim 3 wherein said support members are pulley sheaves.

7. The apparatus of claim 1 wherein each rebound mechanism comprises a housing in which opposing ends of the resiliently stretchable member are received.

8. The apparatus of claim 1 wherein the resiliently stretchable member has two opposing ends, and said at least one stop comprises two stops, each residing adjacent a respective one of said two opposing ends of the resiliently stretchable member.

9. The apparatus of claim 1 wherein each stop comprises a knot tied in or to said resiliently stretchable member.

10. The apparatus of claim 1 wherein each stop comprises an annular washer disposed around said resiliently stretchable member.

11. The apparatus of claim 1 wherein said support structure comprises a cover fitted over open ends of the slotted openings to prevent slippage of the resilient flexible member from said slotted openings through said open ends thereof.

12. The apparatus of claim 1 further comprising a pivotal mount attached or attachable at a first end of the apparatus to movably mount said apparatus to a wall or other upright structure for movement between a deployed position reaching outward therefrom along a floor or ground surface, and a storage position standing upright along said wall or other upright structure.

13. The apparatus of claim 12 further comprising a catch device mounted or mountable on said wall or other upright structure at a spaced elevation above the pivotal mount to selectively secure the apparatus in the storage position by mating with a cooperating catch feature thereon.

14. A hockey training apparatus comprising:

an elongated track;

a practice puck carried on said elongated track and displaceable back and forth therealong on a longitudinal travel path; and at least one rebound mechanism mounted to the track adjacent a respective end of the longitudinal travel path for rebounding of said practice puck back toward an opposing end of the longitudinal travel path upon impact with said rebound mechanism, each rebound mechanism comprising:

a pair of rounded support members disposed on opposite sides of said longitudinal travel path and having curved peripheral surfaces;

a support structure disposed beyond the respective end of the longitudinal path and having a pair of slotted openings therein;

a resiliently stretchable member embraced circumferentially about the curved peripheral surfaces of the rounded support members in a stretched taut position spanning therebetween across the longitudinal travel path and reaching onwardly from rounded each support member through a respective one of the slotted openings in the support structure; and stops carried on the resiliently stretchable member adjacent opposing ends thereof residing respectively behind the slotted openings of the support structure to block sliding of said ends of the resiliently stretchable member therethrough and thereby maintain the stretched taut position of the resiliently stretchable member across the longitudinal travel path.

15. The apparatus of claim 14 wherein each stop comprises a knot tied in or to said resiliently stretchable member.

16. The apparatus of claim 14 wherein each stop comprises an annular washer disposed around said resiliently stretchable member.

17. The apparatus of claim 14 wherein said support structure comprises a cover fitted over open ends of the slotted openings to prevent slippage of the resilient flexible member from said slotted openings through said open ends thereof.

* * * * *